US005117896A

United States Patent [19]

Tavernin

[11] Patent Number: 5,117,896

[45] Date of Patent: Jun. 2, 1992

[54] PROCESS AND DEVICE FOR THE CONTINUOUS CASTING OF THIN METAL PRODUCTS BETWEEN TWO ROLLS

[75] Inventor: Hervé Tavernin, Vandoeuvre, France

[73] Assignee: Usinor Sacilor, Puteaux, France

[21] Appl. No.: 604,056

[22] Filed: Oct. 26, 1990

[30] Foreign Application Priority Data

Oct. 27, 1989 [FR] France ..... 89 14251

[51] Int. Cl.[5] ..... B22D 11/06; B22D 11/10

[52] U.S. Cl. ..... 164/473; 164/428; 164/480

[58] Field of Search ..... 164/480, 428, 473, 472, 164/429, 479

[56] References Cited

U.S. PATENT DOCUMENTS

| | | | |
|---|---|---|---|
| 690,917 | 1/1902 | Bildt | 164/428 |
| 1,947,493 | 2/1934 | Rose et al. | 427/292 X |
| 2,314,902 | 3/1943 | Shepard | 427/292 |
| 4,784,209 | 11/1988 | Hiinka et al. | 164/428 |
| 4,811,780 | 3/1989 | Yamauchi et al. | 164/480 X |

FOREIGN PATENT DOCUMENTS

| | | | |
|---|---|---|---|
| 1364717 | 5/1964 | France . | |
| 2628993 | 9/1989 | France . | |
| 58-179543 | 10/1983 | Japan | 164/428 |
| 61-162249 | 7/1986 | Japan | 164/473 |
| 1-17782 | 4/1989 | Japan | 164/473 |
| 1-205854 | 8/1989 | Japan | 164/472 |
| 846076 | 7/1981 | U.S.S.R. | 164/428 |

OTHER PUBLICATIONS

Abstract of Japanese Patent Publication 62-214444 published Jan. 29, 1987.

Abstract of Japanese Patent Publication 1-104449 published Apr. 21, 1989.

Abstract of Japanese Patent Publication 63-171253 published Jul. 15, 1988.

Abstract of Japanese Patent Publication 58-187244 published Nov. 1, 1983.

Abstract of Japanese Patent Publication 61-1451 published Jan. 7, 1986.

Abstract of Japanese Patent Publication 59-199150 published Nov. 12, 1984.

*Primary Examiner*—J. Reed Batten, Jr.

*Attorney, Agent, or Firm*—Fay, Sharpe, Beall, Fagan, Minnich & McKee

[57] ABSTRACT

The process imparts heat during their solidification to the edge portions of a thin metal product (4) which is continuously cast in a machine comprising a casting space defined by two rotating rolls (1, 1') and two lateral closing plates (2, 2'). The process comprises applying on the portions (9) of the cooled surface of the rolls close to the lateral closing plates a coating of consumable material (5) which is adapted to react in an exothermic manner with the metal which comes in contact with the coating. A roll of a continuous casting device adapted for this purpose is provided together with a continuous casting device for carrying out the process.

22 Claims, 1 Drawing Sheet

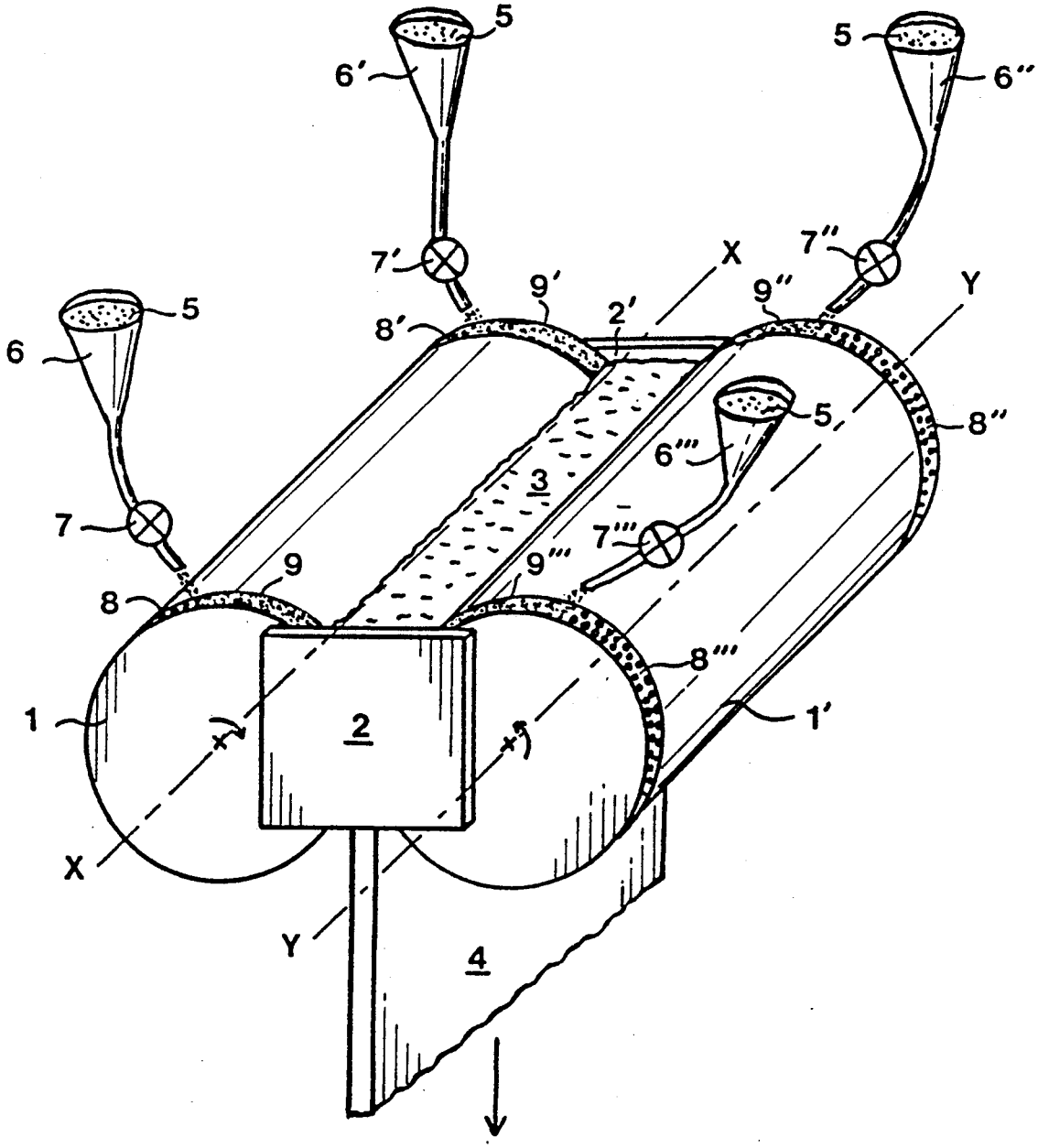
5
6'
5
6''
7'
7''
X
9'
9''
Y
2'
8'
5
6
8''
5
6'''
3
7
7'''
9
9'''
8
8'''
1
1'
2
X
Y
4

PROCESS AND DEVICE FOR THE CONTINUOUS CASTING OF THIN METAL PRODUCTS BETWEEN TWO ROLLS

The invention relates to the field of the continuous casting of thin products of metal, particularly steel, by the technique termed casting between two rolls.

It will be recalled that this technique broadly consists in using a machine comprising:

two rolls disposed side by side, rotating in opposite directions, preferably composed of copper or a copper alloy, and energetically cooled by a circulation of water. These rolls define therebetween a casting space in which the molten metal, which is continuously introduced, solidifies upon contact with the cold walls of the rolls so that it can be extracted in the form of a product which is already completely solidified in the region of the gap between the rolls or in the immediate vicinity of the gap;

and two fixed lateral plates which sealingly close the casting space at the ends of the rolls. These plates, whose part in contact with the cast metal is usually of a refractory material, will be designated hereinafter by the conventional term "side dams".

One of the difficulties encountered in the application of this process in the continuous casting of thin blanks of metals having a high melting point, such as steel, resides in the undesirable solidification of the metal in contact with the side dams in the upper zone of the ingot mould, i.e. above the gap (plane containing the axes of the rolls). If this solidification is excessive, the solidified skin is liable to become attached to the side dams. This may cause, when extracting the product from the ingot mould, a tearing of the hardly solidified skin and in an effusion of the liquid metal below the ingot mould (phenomenon termed "break out". If the metal part solidified on the side dams does not become attached to the latter, it will be rolled by the rolls and cause, as the case may be, the formation of defects on the product, even the jamming of the machine or the deterioration of the rolls if the pressure the latter must exert to maintain a given thickness of the product is excessive.

These difficulties are more serious at the beginning of the casting, since the liquid metal then comes in contact with cold side dams.

It is therefore desirable to delay the solidification of the product in the vicinity of the side dams. To this end, devices ensuring a reheating of the side dams before and/or during the casting have been proposed, for example in the Utility Certificate Application FR 8804471 in the name of the applicant. Such devices imply a construction and a utilization of the machine requiring a perfect technological mastery.

That application is incorporated herein by reference.

Another solution resides in intervening in the cooling of the metal in the zones of the contact of the latter with the casting rolls in the vicinity of the side dams, for example by heating by means of burners the portions of the rolls which will come in contact with the metal forming the edge portions of the product (Patent Application JP 6209751).

An object of the invention is to slow down the cooling of the edge portions of the product during their solidification so as to render them more malleable and less liable to become attached to the side dams.

The invention therefore provides a process for supplying heat during their solidification to the edge portions of a thin metal product produced by a continuous casting in a machine comprising a casting space defined by two rotating rolls and two lateral closing plates, termed "side dams", characterized in that there is applied on portions of the cooled surface of the rolls close to the side dams a coating adapted to react in an exothermic manner with the metal which comes in contact therewith.

The invention also provides a roll of a machine for the continuous casting of metal products between two rolls, characterized in that it comprises, in the vicinity of each of the portions thereof adapted to come in contact with the side dams, an annular zone including a recessed surface engraving which promotes the adhesion of a consumable exothermic coating.

The invention also provides a device for the continuous casting of metal products between two rotating cooled rolls, characterized in that it comprises means for applying in a continuous or discontinuous manner on portions of the cooled surface of the rolls close to the side dams, a coating adapted to react in an exothermic manner with the metal which comes in contact therewith.

As will have been understood, the exothermic coating reacts with the metal which will subsequently constitute the edge portions of the product and locally raises in this region the temperature of this metal and thus absorbs the extra cooling of the edge portions resulting from the proximity of the side dams.

The accompanying single FIGURE, which shows diagrammatically in perspective the upper part of a machine for continuous casting between rolls modified in accordance with the invention, will help to explain the invention.

Shown in this FIGURE are cooled rolls 1, 1' rotating in opposite directions around two parallel axes X—X and Y—Y contained in a common horizontal plane. They define therebetween a casting space which is laterally closed off by side dams 2, 2'. The liquid steel 3, which is continuously poured from a supply vessel (not shown), fills this casting space where it solidifies and forms a product 4 which is extracted downwardly from the machine by the effect of the rotation of the rolls. The material 5 adapted to constitute the exothermic coating is contained in vessels 6, 6', 6'', 6''' from which it flows and comes to be deposited, for example merely under the effect of gravity, on the zones of the rolls 1, 1' which are the closest to the side dams 2, 2'. The vessels 6, 6', 6'', 6''' are provided with means 7, 7', 7'', 7''' for controlling the rate of flow of the material 5. Prior to their coming in contact with the liquid steel, the zones of the rolls 8, 8', 8'', 8''' the closest to the side dams are in this way each coated with a band 9, 9', 9'', 9''' of an exothermic coating. Each of these zones is about 10 mm. in width and is located on the edge portions of the rolls if the side dams are placed against the ends of the rolls. The adhesion of the coating is promoted if the zones 8, 8', 8'', 8''' include a recessed surface engraving, such as a plurality of cavities symbolically represented in the FIGURE, which act as receptacles for the coating.

This coating is formed by a product capable of rapidly reacting in an exothermic manner upon contact with the liquid metal. It may for example contain essentially metal elements such as aluminium, silicon or calcium whose simple solution in the liquid steel is exothermic. This effect is still further accentuated if the liquid steel is uncompletely deoxidized, which permits the metal elements to react with the oxygen dissolved in the metal, which reaction is itself exothermic. These metal elements may also be mixed with oxides capable of being reduced by those at high temperature, such as iron and/or manganese oxides. Thus, the deoxidizers can continue to react exothermically even after the coating has been covered by the solidified metal skin to which the heat is then transmitted.

The cohesion of the coating may be ensured by a mineral or organic binder which facilitates the application of the coating on the edge portions of the rolls by suitable means and its adhesion to the rolls up to its contact with the metal. The deposition merely by the effect of gravity may in this way be replaced by a deposition by a spraying or coating method. The coating is regenerated by said application means in a continuous manner, or in a discontinuous manner if it is not entirely consumed after a single contact with the metal. The binder must have a heat capacity which is as low as possible so that it does not reduce too much the effectiveness of the exothermic products.

The solution and the reaction of the powder and its binder within the metal may result in a local modification of the composition of the steel forming the edge portions relative to the rest of the product. But as the edge portions of thin products cast between rolls generally present irregularities in shape and structure which often require their removal, this pollution does not constitute a serious drawback.

The invention is also applicable to machines provided with so-called "translatable" rolls whereby it is possible to vary the width of the product by shifting the rolls in directions parallel to each other between two castings or during a casting. In this case, the means for applying the coating must be movable so as to follow the displacements of the edge portions of the product.

I claim:

1. Process for providing heat, during their solidification, to edge portions of a thin metal product produced by a continuous casting of metal in a machine comprising a casting space defined by two rotatable rolls and two lateral closing plates, termed side dams, said rolls having a cooled surface, said process comprising applying on portions of said cooled surface of said rolls, which are close to said side dams, a coating of consumable material for reacting in an exothermic manner with said metal which comes in contact with said coating.

2. Process according to claim 1, wherein said coating comprises elements for deoxidizing liquid steel.

3. Process according to claim 2, wherein said deoxidizing element is aluminium.

4. Process according to claim 2, wherein said deoxidizing element is silicon.

5. Process according to claim 2, wherein said deoxidizing element is calcium.

6. Process according to claim 2, wherein said coating further comprises oxides which are reducible by said deoxidizing elements.

7. Process according to claim 6, wherein said oxides are iron oxides.

8. Process according to claim 6, wherein said oxides are manganese oxides.

9. Process according to claim 1, wherein said coating comprises powdered active elements and a binder mixed with said active elements.

10. Process according to claim 9, wherein said binder is organic.

11. Process according to claim 9, wherein said binder is mineral.

12. The process of claim 1 wherein said step of applying consumable material is performed continuously during the continuous casting of metal.

13. The process of claim 1 further comprising the step of adhering the consumable material to said portion of said cooled surface of said rolls, which portions are close to said side dams.

14. The process of claim 13 wherein said step of adhering comprises the subsidiary step of depositing the consumable material in recessed surface engravings in said rolls adjacent said side dams.

15. A device for the continuous casting of metal products, said device comprising two rotatable rolls and two lateral closing plates termed "side dams" defining with said rolls a casting space for receiving molten metal, said rolls having a cooled surface, a source of a material which can react in an exothermic manner with said molten metal, and a means for applying on portions of said cooled surface of said rolls close to said side dams a coating of said material.

16. A device according to claim 15, comprising means for continuously effecting said application.

17. A device according to claim 15, comprising means for discontinuously effecting said application.

18. A device according to claim 15, wherein each of said rolls comprises, in the vicinity of each of said portions of said roll adapted to come in contact with said side dams, an annular zone including a recessed surface engraving which promotes the adhesion of said exothermic coating which is consumable.

19. A device according to claim 18, wherein said recessed engraving provides a plurality of cavities.

20. A device according to claim 14, wherein said means for applying said coating is operative by a spraying action.

21. A device according to claim 15, wherein said means for applying said coating is operative by a coating action.

22. The device of claim 15 further comprising a means for adhering said material to said portions of said cooled surface of said rolls close to said side dams.

* * * * *